US006823703B2

(12) United States Patent
Shiao et al.

(10) Patent No.: US 6,823,703 B2
(45) Date of Patent: Nov. 30, 2004

(54) REMOVABLE PLUG CYLINDER LOCK

(75) Inventors: Ming Liang Shiao, Anaheim Hills, CA (US); Frank Minnella, Fountain Valley, CA (US)

(73) Assignee: Lock America, Inc., Garden Grove, CA (US)

( * ) Notice: Subject to any disclaimer, the term of this patent is extended or adjusted under 35 U.S.C. 154(b) by 0 days.

(21) Appl. No.: 10/117,375

(22) Filed: Apr. 5, 2002

(65) Prior Publication Data

US 2003/0188558 A1 Oct. 9, 2003

(51) Int. Cl.[7] ..... E05B 9/04
(52) U.S. Cl. ..... 70/369; 70/371; 70/379 R
(58) Field of Search ..... 70/367–371, 379 R, 70/380

(56) References Cited

U.S. PATENT DOCUMENTS 3,702,549 A * 11/1972 Solovieff et al. ..... 70/370 X
3,871,284 A 3/1975 Krise
3,899,907 A * 8/1975 Prahl ..... 70/370
3,919,867 A * 11/1975 Lipschutz et al. ..... 70/371 X
4,006,614 A * 2/1977 Decker ..... 70/371 X
4,099,397 A 7/1978 Dauenbaugh
4,123,926 A 11/1978 Elder
4,191,037 A * 3/1980 Patriquin ..... 70/369
4,228,873 A * 10/1980 Nyborg, Jr. ..... 70/91 X
4,386,510 A 6/1983 Best
4,424,693 A * 1/1984 Best et al. ..... 70/369
RE31,910 E 6/1985 Oliver
4,539,828 A * 9/1985 Teleky ..... 70/369
4,688,405 A * 8/1987 Epstein ..... 70/371 X
4,703,638 A * 11/1987 Bergstrom ..... 70/369 R
4,843,852 A * 7/1989 Foshee et al. ..... 70/367
4,914,932 A * 4/1990 Walla ..... 70/367
4,920,774 A 5/1990 Martin
5,010,753 A * 4/1991 Boris, Jr. ..... 70/371
5,121,619 A * 6/1992 Martin ..... 70/371
5,193,372 A * 3/1993 Sieg et al. ..... 70/369
5,634,359 A * 6/1997 Huebschen ..... 70/379 R
5,813,260 A 9/1998 Widen
5,979,200 A 11/1999 Cliff
6,076,386 A 6/2000 Etchells
6,338,261 B1 1/2002 Liu

* cited by examiner

*Primary Examiner*—Suzanne Dino Barrett
(74) *Attorney, Agent, or Firm*—Marvin H. Kleinberg; Marshall A. Lerner; Kleinberg & Lerner, LLP

(57) ABSTRACT

A removable locking plug that is easily inserted and/or removed from the cylinder portion of the locking mechanism. In the preferred embodiment, the plug is enclosed in a case hardened steel housing and contains a tumbler keyed locking mechanism.

5 Claims, 2 Drawing Sheets

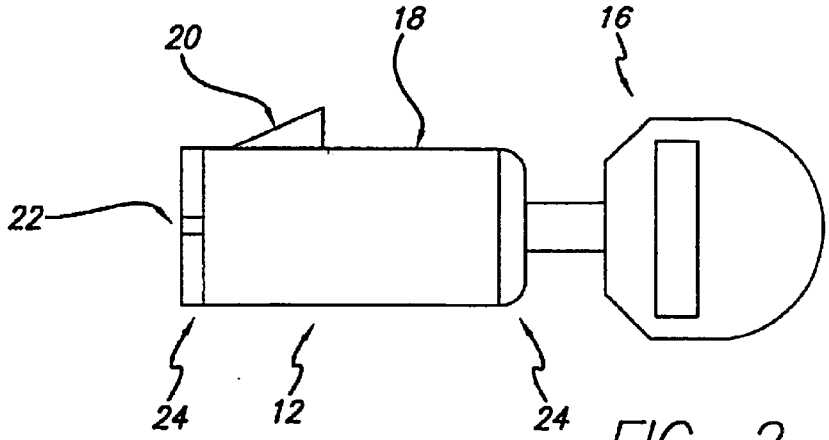
FIG. 2
FIG. 3
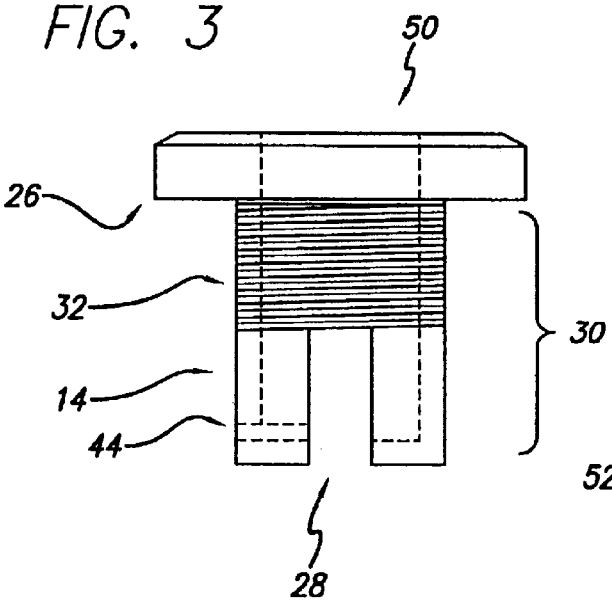
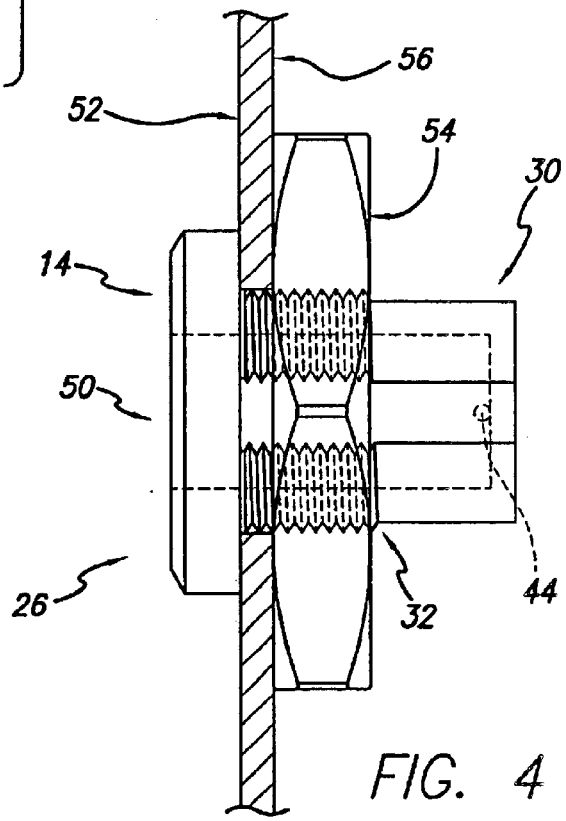
FIG. 4

REMOVABLE PLUG CYLINDER LOCK

BACKGROUND

1. Field of the Invention

The present invention relates generally to the field of locks, and more specifically to a removable plug cylinder lock such as may be used in vending machine coin boxes.

2. Prior Art

Locks and removable plug cylinder locks are well known in prior art. These locks are used in vending machines, cash boxes, parking meters and the like. An excellent discussion of the nature of the coin box used in the machines is found in U.S. Pat. No. 3,871,284, issued on Mar. 18, 1975 to Krise, for a "Coin Box and Lock Mechanism". As explained in the '284 patent, a coin box is typically securely affixed inside a vending machine with an opening in the vending machine to allow access to the contents of the coin box. A metal plate covers the opening with an appropriate fastening mechanism that requires a special access tool. A smaller aperture located in the cover, designed to allow special access to the fastening mechanism, is blocked by a cylinder plug lock. The current invention relates to improvements in cylinder plug lock technology.

The cylinder plug lock includes a locking plug portion that slides in and out of a hollow cylinder portion. The cylinder portion is rigidly affixed to the cover plate. When the plug is properly aligned the cylinder, the plug may be secured and the plug key removed. A problem arises when inserting the plug because prior art devices have made it sometimes difficult to align the plug properly within the cylinder.

Prior art lacks a plug that easily and unmistakably seats into a position that easily allows the removal of the plug key without removing the plug as well. Stated slightly differently, prior art devices did not provide a foolproof way to inform the installer that the plug was properly aligned, so that the installer could then remove the key without also removing the plug. Often, when using prior art devices, the installer was left fumbling, sometimes in the dark and sometimes in extreme cold while wearing gloves, trying to get the plug rotationally and/or axially aligned correctly to complete installation of the plug into a locked and secured position.

One prior art method of aligning the plug is to use a "c-clip" or spring bar that attaches to the plug and installs into a groove when the plug is inserted into the cylinder. The clip/bar is initially compressed within the cylinder until it aligns with the groove in the inside diameter of the cylinder and then expands into the groove to hold the plug in place while the locking mechanism is actuated. The ease with which the user aligns the plug to the cylinder depends on the flexibility of the clip and the ability of the user to feel and/or hear the clip/bar snap into place. If the clip/bar is too rigid, it will be difficult to remove the plug after it is aligned and seated. If the clip/bar is too flexible, it is harder to know when the groove that aligns and seats the plug within the cylinder is engaged.

Another common prior art technology requires two keys for the lock. The first key operates the tumbler mechanism within the lock. The second key is slightly longer and moves a pin that releases the plug and allows it to be removed from the cylinder. The use of the two keys raises the inevitable possibility that at least one of the keys will be lost, rendering the lock useless.

Thus, a method and a device are needed that allow a plug to be easily, quickly and unmistakably aligned within a lock cylinder when inserting the plug into the lock cylinder. Further, such a device should not require two keys to operate.

Further features and advantages of the present invention will be appreciated by reviewing the following drawings and detailed description of the invention.

BRIEF SUMMARY OF THE INVENTION

According to the present invention, a removable locking plug is easily inserted and/or removed from the cylinder portion of the locking mechanism. In the preferred embodiment, the plug is enclosed in a case hardened steel housing and contains a tumbler keyed locking mechanism. It has a key activated latch that extends and retracts radially from the sidewall of the plug housing. With the latch in the retracted position, the plug can fit snugly into the cylinder.

In the preferred embodiment, the cylinder has an inner flange at the rearward end. An alignment lug or pin extends radially inward from the wall at the inner flange. The plug has an alignment notch to receive the lug/pin when the plug is properly aligned within the cylinder. Cooperation between the alignment notch and the alignment pin acts to prevent rotational movement of the plug within the cylinder. When so aligned, the latch can be extended into a locking notch cut into the cylinder wall at the inner end, preventing the plug from both axial and rotational movement within the cylinder. The plug key may then be removed without removing the plug.

BRIEF DESCRIPTION OF THE DRAWINGS

For a further understanding of the objects and advantages of the present invention, reference should be had to the following detailed description, taken in conjunction with the accompanying drawing, in which like parts are given like reference numbers and wherein:

FIG. 2 is a side view of the plug, with the latch extended;

FIG. 3 is a side view of the cylinder; and

FIG. 4 is a side view of the cylinder installed on a planar surface.

DETAILED DESCRIPTION OF THE INVENTION

Figure 1:
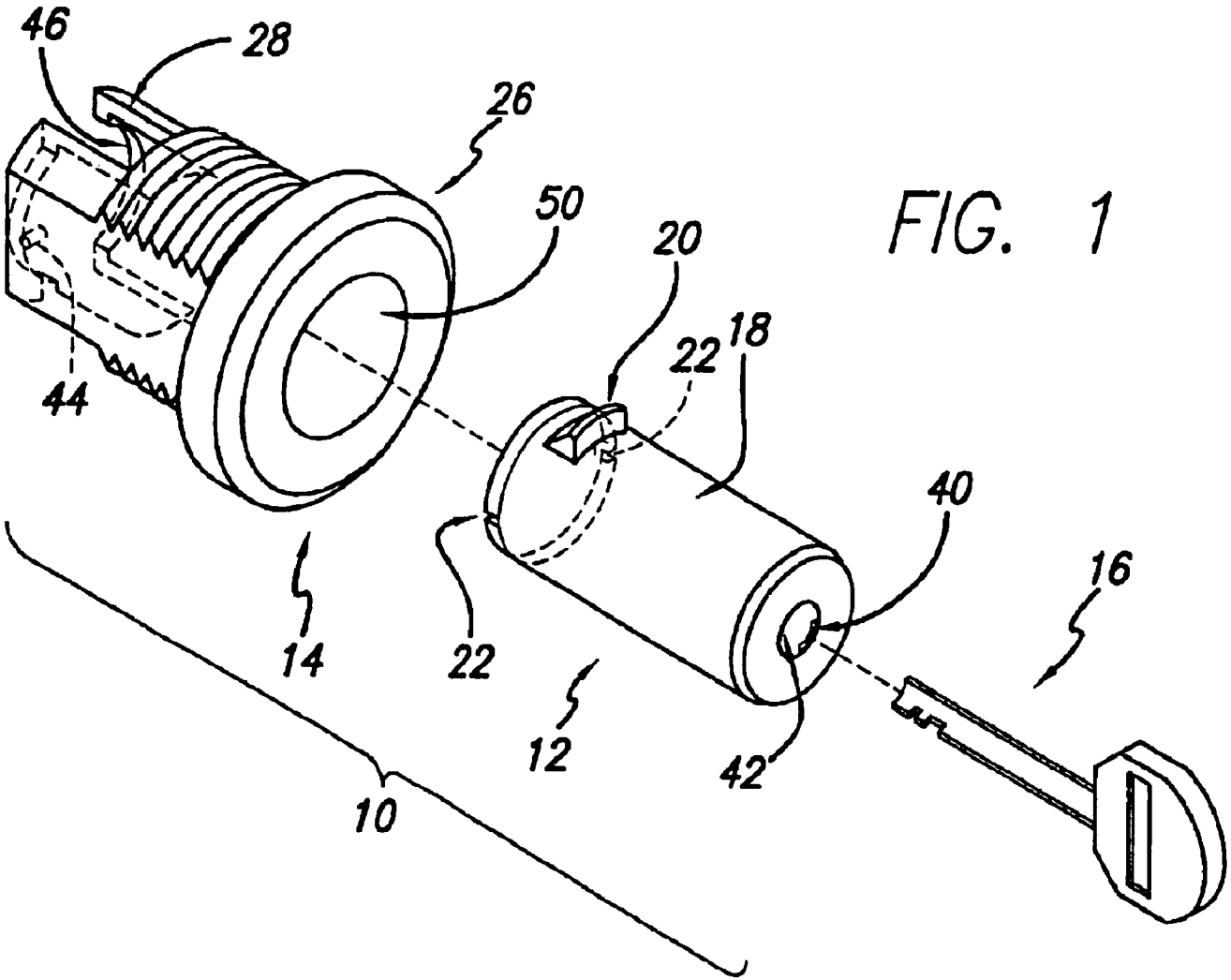
FIG. 1 is perspective of the plug aligned with, but separated from, the cylinder.

In the following description, for the purposes of explanation, specific component arrangements and constructions and other details are set forth in order to provide a more thorough understanding of the present invention. It will be apparent to those skilled in the art, however, that the present invention may be practiced without these specific details. In other instances, well known manufacturing methods and structures have not been described in detail so as not to obscure the present invention unnecessarily.

Referring first to FIG. 1, a cylinder with a removable plug lock 10 is shown with the plug 12 withdrawn from the cylinder 14. The plug 12 includes a tumbler mechanism (not shown) that is operated by a removable key 16.

Shown in FIG. 2 is a side elevation of one embodiment of the plug case 18. In this embodiment, the plug case 18 has two locking notches 28. The two locking notches 28 are of equal size and are positioned directly opposite of each other at the rearward base of the plug case 18. The plug case 18 must have at least one locking notch 28. However, the number of locking notches 28 is not a limiting factor in the invention. The plug 12 is encased in a case 18, with the key 16 fully inserted into the plug 12. The plug 12 and plug case 18 are cylindrical in shape. On the side of the plug 12, at its base, the plug 12 has a latch 20 that is operated by the key 16 and extends or retracts. In FIGS. 1 and 2, the latch 20 is shown in the extended position. Also at the base of the plug 12 is a plug alignment notch 22. Caps 24 are shown on both ends of the plug 12.

Referring next to FIG. 3, the cylinder 14 is shown. In the preferred embodiment, the cylinder 14 has a forward flange 26 extending radially outwards. At its base, the cylinder has a locking notch 28 that cooperates with the latch 20 to prevent axial and rotational movement of the plug 12 when the latch 20 (not shown in FIG. 3) is extended. Extending below the forward flange 26 is a shaft 30 that has a smaller diameter than the flange. Threads 32 are placed on the outside surface of the shaft to allow a nut (not shown in this figure) to be threaded onto the cylinder 14.

Referring back to FIG. 1, the plug 12 has a keyhole 40 mounted on its forward face 42. The latch 20, operated by the rotation of a key 16 inserted into the keyhole 40, is capable of retracting into or extending beyond the surface of the plug casing 18. With the latch 20 in its retracted position, the plug 12 may easily slide in and out of the cylinder 14. When the plug 12 is fully inserted into the cylinder 14 and rotation of the plug 12 is prevented by cooperation between the cylinder alignment lug/pin 44 and the plug alignment notch 22, the key 16 can be operated to advance or retract the latch 20.

To insert the plug 12 into the cylinder 14 and into a position such that the key 16 can be removed from the keyhole 40, the plug 12 is placed axially within the cylinder 14. When the inward axial movement is impeded by the alignment lug/pin 44, the plug 12 will not fully insert into the cylinder 14. The plug 12 is then rotated in either direction until the plug alignment notch 22 is aligned, and mates with, the cylinder alignment pin 44. Cooperation between the alignment notch 22 and the alignment pin 44 prevents further rotational movement of the plug 12 within the cylinder 14. While the latch 20 is retracted, and the cylinder alignment pin 44 is cooperating with the plug alignment notch 22, the key 16 within the keyhole 40 is prevented from rotating in one direction, but not in the opposite direction. When further rotational movement is blocked, the key 16 can then operate the latch 20, extending it fully into the cylinder locking notch 28. In its extended position, the latch 20 seats in the cut out locking notch 28 (best seen in FIG. 3), preventing axial and rotational movement of the plug 12 within the cylinder 14. With the latch 20 extended into the cut out locking notch 28, the plug 12 is firmly locked into the cylinder 14 and the key 16 can be withdrawn without removing the plug 12.

In the preferred embodiment, the alignment lug/pin 44 is a small metal pin that protrudes radially inward into the inner surface of the cylinder shaft 30. When the pin 44 is not mated with the alignment notch 22, the plug 12 is prevented from being fully inserted into the cylinder 14. When the pin 44 does align with the alignment notch 22, the notch 22 slips over the pin 44 and the plug fully inserts into the cylinder 14.

The alignment lug/pin 44 need not be of any particular size. However, it should be large enough to prevent the rotational movement of the plug 12, when the alignment lug/pin 44 is mated with the alignment notch 22. Further, the alignment plug/pin 44 need not be made of any specific material, so long as the material that is used is strong enough to prevent the rotation of the plug 12, when the pin 44 and the notch 22 mate. Also, the pin 44 need not be of any specific shape or configuration, so long as it can successfully mate with the notch 22 when the plug 12 is seated within the cylinder 14. A rearward flange 46 (seen in FIG. 1 at the base of the cylinder 14) extends radially inward on the rearward aperture opening.

For ease in operation, a corresponding pair of alignment notches 22 are provided, to correspond to the pair of locking notches 28. Each alignment notch is positioned to engage the alignment lug/pin 44 when the latch 20 is aligned with an associated locking notch 28.

Referring next to FIG. 4, the cylinder 14 is affixed to a planar surface. The cylinder 14 includes a shaft 30 with threads 32 on the exterior diameter of the shaft and a forward flange 26 extending radially outward on the forward aperture opening 50. When used in the preferred embodiment, the cylinder 14 is attached to a planar surface with the cylinder's forward aperture opening 50 and flange 26 adjacent to the exterior surface 52 of a planar surface. The rearward portion of the forward flange 26 is flush with the exterior wall surface 52. A nut 54 is threaded on the cylinder shaft 30 until it closes onto the interior wall surface 56. In this manner, the cylinder 14 is firmly affixed onto a flat surface and access to the operating mechanism of the coin box can be restricted through the use of a lockable plug.

The description of the present invention has been made with respect to specific arrangements and constructions of a removable plug cylinder lock. It will be apparent to those skilled in the art that the foregoing description is for illustrative purposes only, and that various changes and modifications can be made to the present invention without departing from the overall spirit and scope of the present invention. The full extent of the present invention is defined and limited only by the following claims.

What is claimed is:

1. A plug removable cylinder lock, comprising:

a cylinder having
- a hollow interior;
- a forward and rearward aperture opening;
- a flange extending radially outward on said forward aperture opening;
- a flange extending radially inward on said rearward aperture opening;
- an alignment member on the interior of said cylinder at the rearward aperture opening of said cylinder;
- at least one locking notch cut through the wall of said cylinder at said rearward aperture opening of said cylinder;

a cylindrical tumbler-key plug having
- forward face and a rearward face;
- a keyed tumbler mechanism;
- a corresponding keyhole extending radially inward from said forward face;
- a controlling latch member affixed on the side of said plug at said rear face such that said latch can radially extend or retract in cooperation with a key inserted in said keyhole;
- a cylindrical casing having a cap immovably affixed at the each end of said casing;

said cylindrical key plug having at least one alignment notch in said rearward face adapted to engage said alignment member when said latch is aligned with said locking notch;

whereby said latch can only be operated when said plug is seated and properly aligned by said alignment member.

2. A removable core cylinder lock, comprising:

a cylinder having an axially extending cavity including a forward casing aperture and a rear cylinder aperture;

a flange extending radially outward from said forward aperture opening;

an alignment member extending radially inward at said rear cylinder aperture;

at least one cut out locking notch at said rear aperture opening;

a cylindrical, rotatable key plug having a forward face and a rear face and adapted to be axially insertable into said cavity;

at least one alignment cut out notch in said rear face to accommodate said alignment member for preventing rotational movement of said plug;

a latch member extending and retracting from the sidewall of said plug and adapted to be received by said locking notch when aligned therewith; and key operated locking means coupled to said latch member for controlling latch member movement;

whereby said latch member can operate only when said alignment member is engaged in said alignment cut out and said latch is aligned with said locking notch.

3. The invention of claim 2 wherein said rear cylinder aperture has a flange extending radially inward.

4. The invention of claim 2 wherein said cylinder has two said cut out locking notches positioned in said cylinder on the side of said cylinder at said rear aperture opening;

whereby at least one of said two locking notches cooperates with said plug latch member to prevent axial and rotational movement of said plug when said plug latch member is extended into and mates with said at least one said locking notch.

5. The invention of claim 2 wherein said plug rear face has two alignment cut outs to accommodate said cylinder alignment member to prevent rotational movement when said alignment member is mated with at least one of said alignment cut outs;

whereby at least one of said two alignment cut outs cooperates with said alignment member to prevent axial and rotational movement of said plug when said alignment member is coupled with at least one said alignment cut out.

* * * * *